US009449755B2

(12) United States Patent
Weber et al.

(10) Patent No.: US 9,449,755 B2
(45) Date of Patent: Sep. 20, 2016

(54) ARRANGEMENT HAVING AT LEAST TWO COILS WHICH ARE ARRANGED AXIALLY ONE ABOVE THE OTHER ON A COMMON CORE LIMB

(71) Applicants: Benjamin Weber, Winterberg (DE); Bhavesh Patel, Brilon (DE); Burak Esenlik, Paderborn (DE); Frank Cornelius, Olsberg (DE); Marcos Bockholt, Paderborn (DE); Jens Tepper, Brilon (DE)

(72) Inventors: Benjamin Weber, Winterberg (DE); Bhavesh Patel, Brilon (DE); Burak Esenlik, Paderborn (DE); Frank Cornelius, Olsberg (DE); Marcos Bockholt, Paderborn (DE); Jens Tepper, Brilon (DE)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 13/624,529

(22) Filed: Sep. 21, 2012

(65) Prior Publication Data

US 2013/0021130 A1 Jan. 24, 2013

Related U.S. Application Data

(63) Continuation of application No. PCT/EP2011/001155, filed on Mar. 9, 2011.

(30) Foreign Application Priority Data

Mar. 23, 2010 (EP) ..... 10003059

(51) Int. Cl.
*H01F 27/30* (2006.01)
*H01F 21/04* (2006.01)
*H01F 27/32* (2006.01)

(52) U.S. Cl.
CPC ..... *H01F 27/324* (2013.01); *H01F 27/323* (2013.01); *H01F 2027/328* (2013.01)

(58) Field of Classification Search
CPC ..... H01F 2027/328
USPC ..... 336/123–125, 129, 137, 138, 147, 336/183–185, 198, 206
See application file for complete search history.

(56) References Cited

U.S. PATENT DOCUMENTS

| | | | | |
|---|---|---|---|---|
| 2,339,625 | A * | 1/1944 | De Blieux | 336/57 |
| 2,359,544 | A | 10/1944 | Guglielmo | |
| 2,924,799 | A | 2/1960 | Hatfield | |
| 3,699,488 | A | 10/1972 | Goodman et al. | |
| 2007/0246594 | A1 | 10/2007 | Pan | |

FOREIGN PATENT DOCUMENTS

| | | |
|---|---|---|
| DE | 28 50 190 A1 | 5/1980 |
| DE | 102 38 521 A1 | 3/2004 |
| GB | 1 024 624 A | 3/1966 |

OTHER PUBLICATIONS

English Abstract translation of DE 2850190.*
International Search Report (PCT/ISA/210) issued on Apr. 27, 2011, by the European Patent Office as the International Searching Authority for International Application No. PCT/EP2011/001155.

* cited by examiner

*Primary Examiner* — Elvin G Enad
*Assistant Examiner* — Ronald Hinson
(74) *Attorney, Agent, or Firm* — Buchanan Ingersoll & Rooney PC

(57) ABSTRACT

An exemplary arrangement includes blocks arranged between the inner winding, the individual barriers and the outer winding in order to maintain defined spacing's along the circumference. At least two coils are arranged axially one above the other on a common core limb. Each coil has at least two windings arranged radially one above the other and barriers are provided between the windings. The barriers of adjacent coils are radially offset with respect to one another, and the edge regions of the barriers engage one another in a comb-like manner.

3 Claims, 4 Drawing Sheets

ARRANGEMENT HAVING AT LEAST TWO COILS WHICH ARE ARRANGED AXIALLY ONE ABOVE THE OTHER ON A COMMON CORE LIMB

RELATED APPLICATION

This application is a continuation under 35 U.S.C. §120 of International Application PCT/EP2011/001155 filed on Mar. 9, 2011 designating the U.S., and which claims priority to European Application EP10003059.2 filed on Mar. 23, 2010, the contents of which are hereby incorporated by reference in their entireties.

FIELD

The disclosure relates to a transformer, such as a transformer having at least two coils arranged axially one above the other on a common core limb, wherein each coil has at least two windings arranged radially one above the other and barriers are provided between the windings.

BACKGROUND

In known coils and transformers, such as dry-type transformers, two or more coils can be arranged axially one above the other on a core limb, wherein each coil has an inner winding, or low-voltage winding, and an outer winding, or high-voltage winding. The spacing between two coils which is specified for a sufficient dielectric strength is calculated depending on the connection of the coils. In addition, it is usual for barriers to be arranged between the inner winding and the outer winding of a coil, which barriers are intended to prevent an electrical flashover between the two windings.

FIG. 4 shows a lateral section of an arrangement including at least two coils in accordance with a known implementation. As shown in FIG. 4, a core limb includes a first coil 1 and a second coil 4 are arranged axially one above the other. The first coil 1 has two windings 2, 3 arranged radially one above the other, wherein winding 2 is also designated as inner winding or low-voltage winding, and winding 3 is also designated as outer winding or high-voltage winding. The second coil 4 has two windings 5, 6 arranged radially one above the other, wherein winding 5 is also designated as inner winding or low-voltage winding, and winding 6 is also designated as outer winding or high-voltage winding.

A plurality of barriers 51 is arranged between the inner winding 2 and the outer winding 3 of the first coil 1 in order to reliably prevent an electrical flashover between the two windings 2, 3. In a similar manner, a plurality of barriers 52 is arranged between the inner winding 5 and the outer winding 6 of the second coil 4 in order to reliably prevent an electrical flashover between the windings 5, 6.

The axial spacing between the two coils 1, 4, to be determined in dependence on the connection of the coils and the voltage differences, is designated as A1 (measured between the inner windings 2, 5). The barrier projection, that is to say the amount by which a barrier projects over the end face of a winding, arranged perpendicular to the winding axis W, is designated as B (measured between winding 3 and barrier 51 and between winding 6 and barrier 52).

For higher voltages or voltage differences, the specified barrier projections over the windings of the individual coils can be relatively large and therefore lead to a lengthening of the core limb—e.g., core limb length L1.

SUMMARY

An exemplary arrangement is disclosed comprising: at least two coils arranged axially one above the other on a common core limb, wherein each coil has at least two windings arranged radially one above the other and barriers are provided between the windings, and wherein the barriers of adjacent coils are radially offset with respect to one another, and in edge regions of the barriers engage one another in a comb-like manner.

An exemplary arrangement is disclosed comprising: at least two coils arranged axially one above the other on a common core limb, wherein each coil has at least two windings arranged radially one above the other and barriers are provided between the windings, and wherein the barriers of mutually directly opposite areas of adjacent coils are alternately shortened and lengthened.

An exemplary arrangement is disclosed comprising: at least two coils arranged axially one above the other on a common core limb, wherein each coil has at least two windings arranged radially one above the other and barriers are provided between the windings, wherein some of the barriers are designed as insulation rings which additionally engage around end faces of the windings, and wherein the end faces are arranged perpendicular to the winding axis.

BRIEF DESCRIPTION OF THE DRAWINGS

The disclosure is explained in the following text with reference to the exemplary embodiments shown in the drawing, in which.

DETAILED DESCRIPTION

Exemplary embodiments of the present disclosure provide an arrangement, optimized with respect to the specified dimensioning, having at least two coils arranged axially one above the other on a common core limb.

In accordance with one exemplary embodiment barriers of adjacent coils can be radially offset with respect to one another, and in that the edge regions of the barriers engage in one another in a comb-like manner.

In accordance with another exemplary embodiment of the present disclosure, barriers of the mutually directly opposite areas of adjacent coils are alternately shortened and lengthened, with the result that a shortened barrier of the one coil always lies opposite a lengthened barrier of the other coil and, conversely, a lengthened barrier of the one coil always lies opposite a shortened barrier of the other coil and, in each coil, a shortened barrier always follows a lengthened barrier.

In accordance with yet another exemplary embodiment of the present disclosure, barriers are designed as insulation rings which additionally engage around the end faces of the windings, which end faces are arranged perpendicular to the winding axis.

The advantages attributable to the exemplary embodiments disclosed herein include reduction of the core limb length of the coil or of the transformer, which leads to an overall more compact design of the coil or of the transformer. The barrier arrangement can be designed such that electrical flashovers from the outerlying winding to the innerlying winding are avoided, although the axial spacing of the coils relative to one another is reduced.

Figure 1:
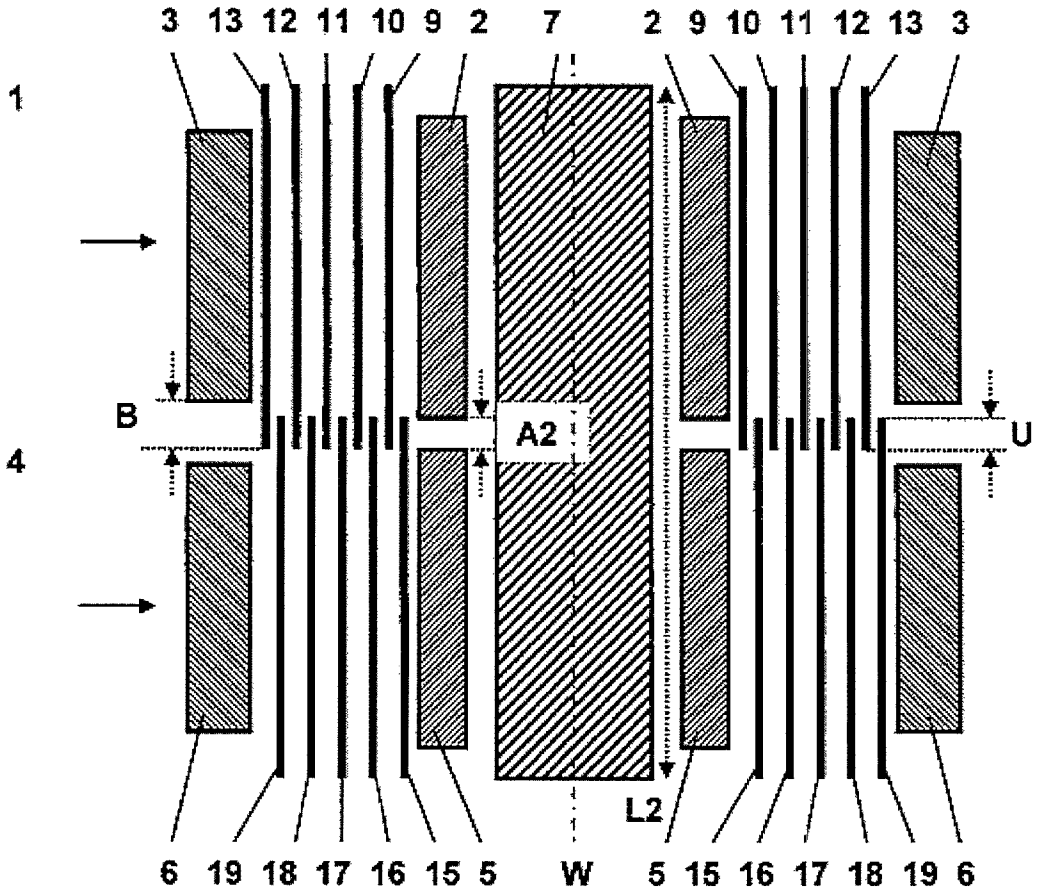
FIG. 1 shows a lateral section of a first optimized arrangement including at least two coils in accordance with an exemplary embodiment of the present disclosure.

FIG. 1 shows a lateral section of a first optimized arrangement including at least two coils in accordance with an exemplary embodiment of the present disclosure. As shown in core limb 7 FIG. 1, includes a first coil 1 and a second coil 4 arranged axially one above the other. The first coil 1 has two windings 2, 3 arranged radially one above the other, wherein winding 2 is also designated as inner winding and winding 3 is also designated as outer winding. The second coil 4 has two windings 5, 6 arranged radially one above the other, wherein winding 5 is also designated as inner winding and winding 6 is also designated as outer winding. The central axis of the core limb 7 is at the same time the winding axis W.

Barriers 9, 10, 11, 12, 13 are arranged between the inner winding 2 and the outer winding 3 of the first coil 1 in order to reliably prevent an electrical flashover between the two windings 2, 3. In a similar manner, barriers 15, 16, 17, 18, 19 are arranged between the inner winding 5 and the outer winding 6 of the second coil 4 in order to reliably prevent an electrical flashover between the two windings 5, 6.

Figure 4:
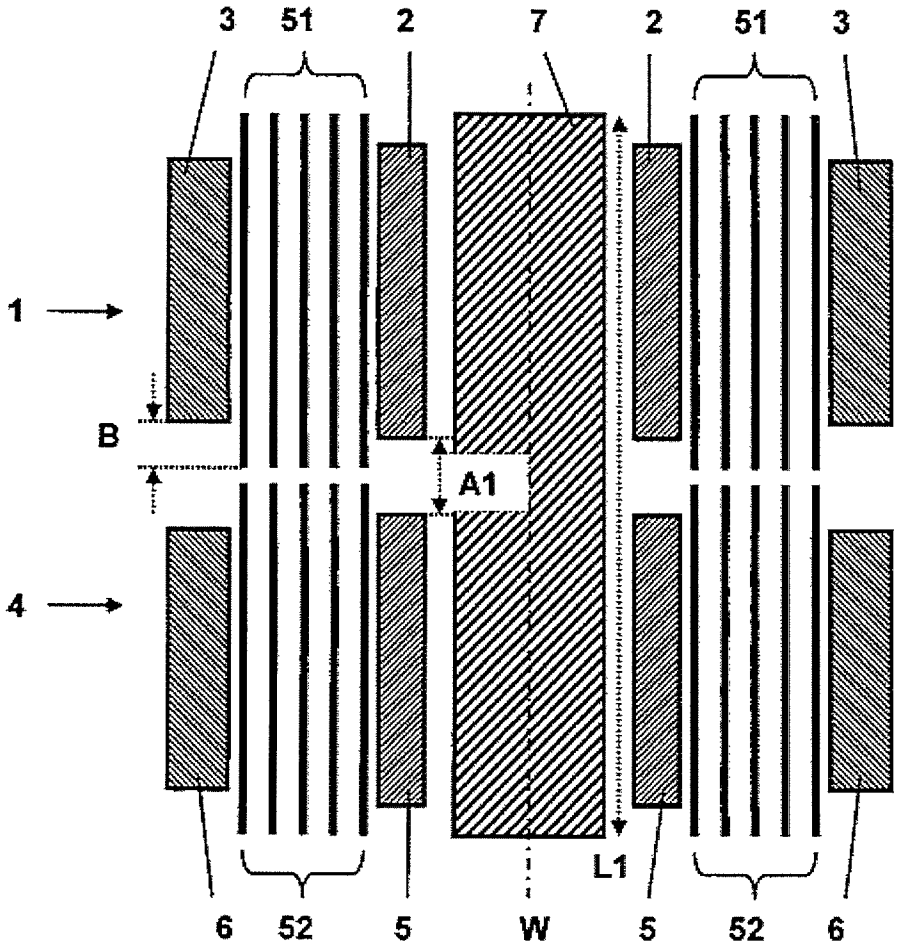
Fig. 4 Prior Art
FIG. 4 shows a lateral section of an arrangement including at least two coils in accordance with a known implementation.

Here, the barriers 9-13 and 15-19 are arranged on the diameter, with the central axis of the core limb being the winding axis W, in such a way that the two coils 1, 4 are able to be moved closer together in the axial direction without the barriers touching one another. As can be seen, the barriers of adjacent coils are arranged radially offset with respect to one another and the edge regions of the barriers 9-13 and 15-19 engage in one another in a comb-like manner. Overlap regions U are formed between the barriers of the adjacent coils 1, 4. The barrier projections B are unchanged here from the embodiment in accordance with FIG. 4. Advantageously, there is a reduced axial spacing A2 in comparison with the axial spacing A1 (see FIG. 4). Correspondingly, the core limb length L2 is reduced.

Figure 2:
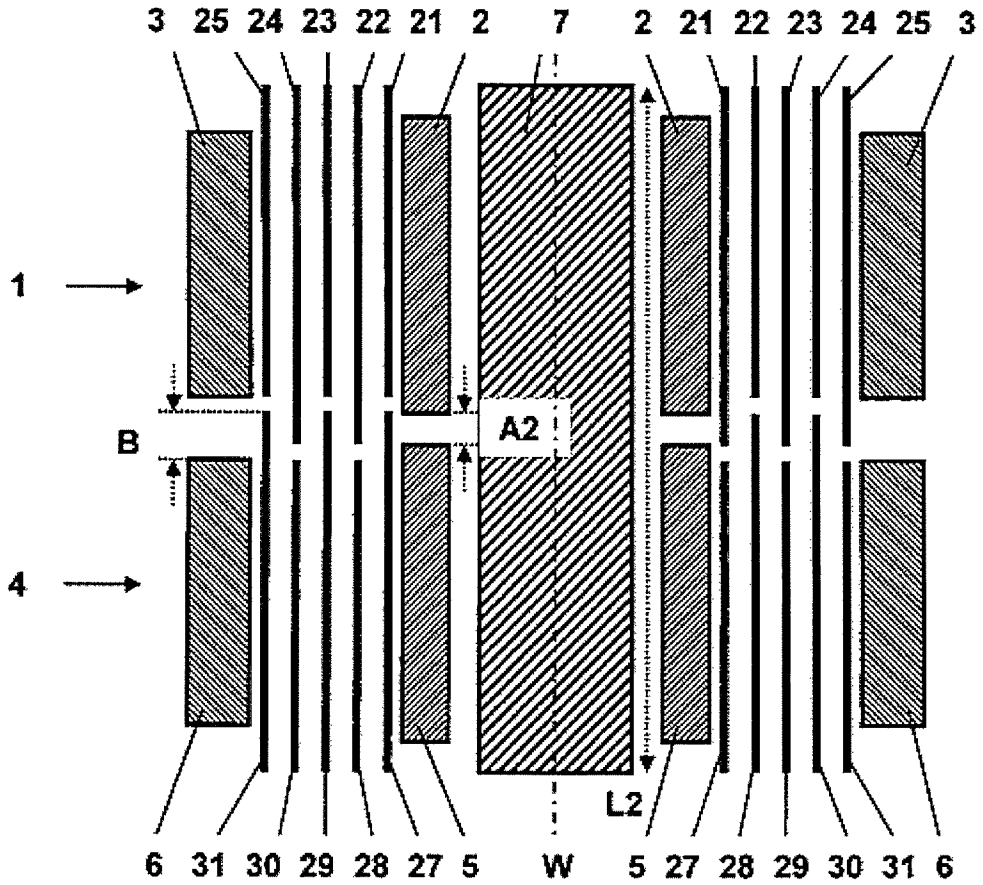
FIG. 2 shows a lateral section of a second optimized arrangement including at least two coils in accordance with an exemplary embodiment of the present disclosure.

FIG. 2 shows a lateral section of a second optimized arrangement including at least two coils in accordance with an exemplary embodiment of the present disclosure. As shown in FIG. 2, a core limb 7 includes a first coil 1 and a second coil 4 are arranged axially one above the other. The first coil 1 has two windings 2, 3 arranged radially one above the other, wherein winding 2 is also designated as inner winding and winding 3 is also designated as outer winding. The second coil 4 has two windings 5, 6 arranged radially one above the other, wherein winding 5 is also designated as inner winding and winding 6 is also designated as outer winding.

Barriers 21, 22, 23, 24, 25 are arranged between the inner winding 2 and the outer winding 3 of the first coil 1 in order to reliably prevent an electrical flashover between the two windings 2, 3. In a similar manner, barriers 27, 28, 29, 30, 31 are arranged between the inner winding 5 and the outer winding 6 of the second coil 4 in order to reliably prevent an electrical flashover between the windings 5, 6.

Here, the barriers 21-25 and 27-31 of the mutually directly opposite areas of the two coils 1, 4 are alternately shortened and lengthened, with the result that a shortened barrier of the one coil lies opposite a lengthened barrier of the other coil and, in each coil, a shortened barrier follows a lengthened barrier. Overlap regions exist between the barriers of adjacent coils 1, 4. In this way, the two coils 1, 4 can be moved closer together in the axial direction without the barriers touching one another. The barrier projection B of a lengthened barrier here corresponds to the barrier projection B in the embodiment of FIG. 4. A shortened barrier 21, 28, 23, 30, 25 lies directly opposite a lengthened barrier 27, 22, 29, 24, 31 without the barriers which lie opposite one another touching. Advantageously, there is a reduced axial spacing A2 in comparison to the axial spacing A1 (see FIG. 4). Correspondingly, the core limb length L2 is reduced.

Figure 3:
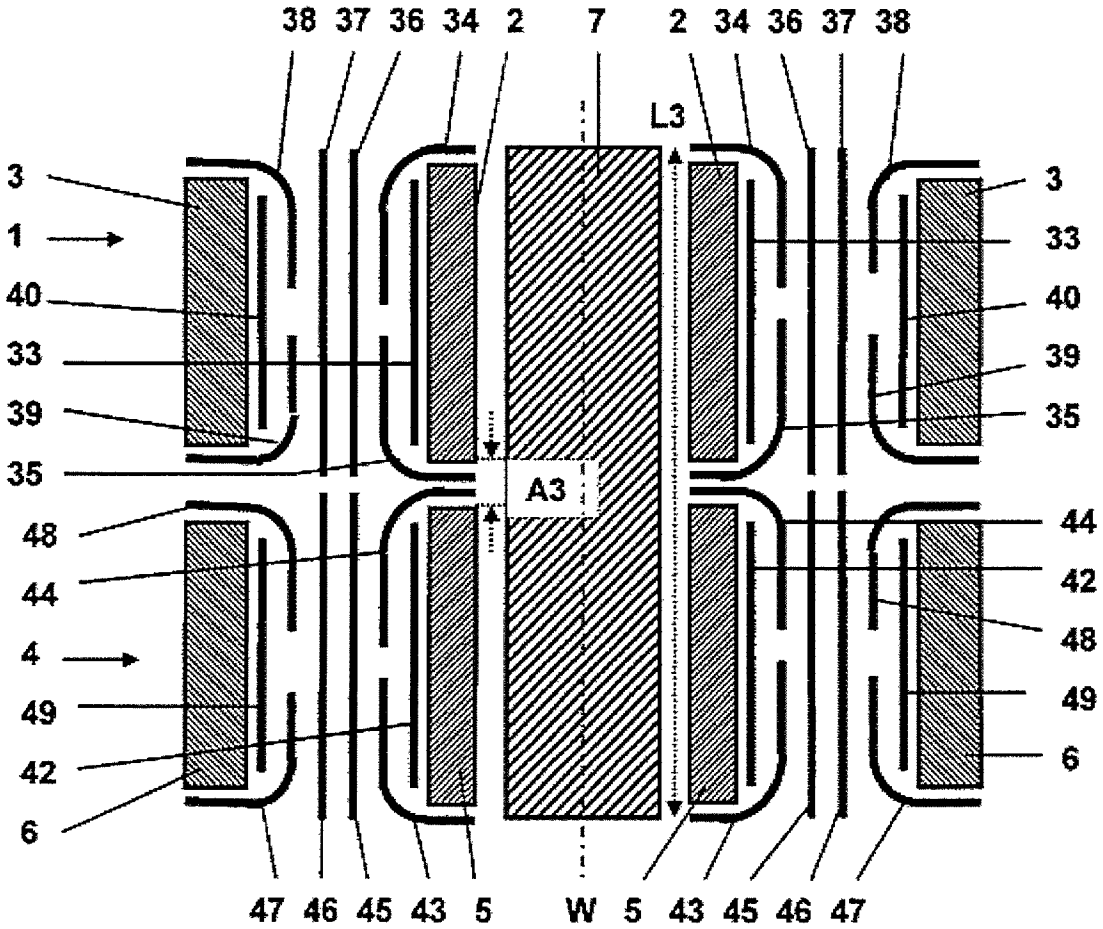
FIG. 3 shows a lateral section of a third optimized arrangement including at least two coils in accordance with an exemplary embodiment of the present disclosure.

FIG. 3 shows a lateral section of a third optimized arrangement including at least two coils in accordance with an exemplary embodiment of the present disclosure. As shown in FIG. 3, a core limb 7 includes a second coil 4 are arranged axially one above the other. The first coil 1 has two windings 2, 3 arranged radially one above the other, wherein winding 2 is also designated as inner winding and winding 3 is also designated as outer winding. The second coil 4 has two windings 5, 6 arranged radially one above the other, wherein winding 5 is also designated as inner winding and winding 6 is also designated as outer winding.

Barriers 33, 36, 37, 40 and insulation rings as barriers 34/35, 38/39 are arranged between the inner winding 2 and the outer winding 3 of the first coil 1 in order to reliably prevent an electrical flashover between the two windings 2, 3. In a similar manner, barriers 42, 45, 46, 49 and insulation rings as barriers 43/44, 47/48 are arranged between the inner winding 5 and the outer winding 6 of the second coil 4 in order to reliably prevent an electrical flashover between the two windings 5, 6. The insulation rings 34/35 additionally engage around the end faces, perpendicular to the winding axis W, of the inner winding 2, the insulation rings 38/39 additionally engage around the end faces, perpendicular to the winding axis W, of the outer winding 3, the insulation rings 43/44 additionally engage around the end face of the inner winding 5, and the insulation rings 47/48 additionally engage around the end face of the outer winding 6. Advantageously, there is a reduced axial spacing A3 in comparison to the axial spacing A1 (see FIG. 4). Correspondingly, the core limb length L3 is reduced.

The following features can be associated with the exemplary embodiments explained above.

The above-described measures are applicable to coils 1, 4 having a circular, oval or rectangular cross section.

The barriers 9-13, 15-19, 21-25, 27-31, 33-40, 42-49 are formed from an electrically insulating plastic.

The barriers 9-13, 15-19, 21-25, 27-31, 33-40, 42-49 of adjacent coils are not intended to touch so that no continuous creepage path is provided here.

The barriers 9-13, 15-19, 21-25, 27-31, 33-40, 42-49 can be wound into the coils 1, 4 and therefore automatically follow the shape of the coils. Alternatively, the barriers 9-13, 15-19, 21-25, 27-31, 33-40, 42-49 can be designed as pre-formed components, in each case matched to the shape and dimensions of the coil 1, 4.

Blocks can be arranged between the inner winding 2, 5, the individual barriers 9-13, 15-19, 21-25, 27-31, 33-40, 42-49 and the outer winding 3, 6 in order to maintain defined spacings along the circumference.

The drawings are somewhat distorted in order to illustrate the principle according to the disclosure and are not to scale with respect to the dimensions of a coil/winding and the illustrated spacings between the windings.

In the aforementioned embodiments, five barriers in each case are used by way of example. The number of barriers has no upper limit. The embodiment shown in FIG. 1 is functional with just one barrier; the embodiments shown in FIGS. 2 and 3 are functional with just 2 barriers.

Various combinations of the exemplary embodiments described herein can be implemented for the barrier configuration. For example, the embodiment of FIG. 3 can be combined with the embodiments of FIG. 1 or FIG. 2 with respect to the barriers arranged in the central region between the windings.

Thus, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

LIST OF REFERENCES

1 first coil
2 inner winding of the first coil
3 outer winding of the first coil
4 second coil
5 inner winding of the second coil
6 outer winding of the second coil
7 core limb
8 —
9 barrier
10 barrier
11 barrier
12 barrier
13 barrier
14 —
15 barrier
16 barrier
17 barrier
18 barrier
19 barrier
20 —
21 barrier
22 barrier
23 barrier
24 barrier
25 barrier
26 —
27 barrier
28 barrier
29 barrier
30 barrier
31 barrier
32 —
33 barrier
34 insulation ring as barrier
35 insulation ring as barrier
36 barrier
37 barrier
38 insulation ring as barrier
39 insulation ring as barrier
40 barrier
41 —
42 barrier
43 insulation ring as barrier
44 insulation ring as barrier
45 barrier
46 barrier
47 insulation ring as barrier
48 insulation ring as barrier
49 barrier
50 —
51 barrier
52 barrier
A1, A2, A3 axial spacing between two coils
B barrier projection
L1, L2, L3 core limb length
U overlap regions
W winding axis

What is claimed is:

1. An arrangement comprising:

at least two coils arranged axially adjacent and one above the other on a winding axis of a common core limb, wherein each coil has a respective set of windings, wherein each set has two windings arranged radially one above the other along the winding axis and respective barriers are provided between the windings, and wherein the respective barriers of the axially adjacent coils extend lengthwise along the winding axis, are spaced apart from one another, are radially offset with respect to one another, and at edge regions located on adjacent ends of the respective barriers of the adjacent coils, the respective barriers overlap lengthwise along the winding axis such that the edge regions are directly adjacent and engage one another in a comb-like manner.

2. The arrangement as claimed in claim 1, wherein the respective barriers are wound into the coil and therefore automatically follow a shape of the coil.

3. The arrangement as claimed in claim 1, wherein the respective barriers are designed as pre-formed components, in each case matched to a shape and dimensions of the coil.

* * * * *